US005170093A

United States Patent [19]

Yamamoto et al.

[11] Patent Number: 5,170,093

[45] Date of Patent: Dec. 8, 1992

[54] METHOD FOR MANUFACTURING COLOR CATHODE RAY TUBE

[75] Inventors: Morio Yamamoto; Tetsuya Watanabe, both of Nagaokakyo; Tohru Hanada, Amagasaki; Kozoo Nukui, Amagasaki; Katsuhiro Ono, Amagasaki, all of Japan

[73] Assignee: Mitsubishi Denki Kabushiki Kaisha, Tokyo, Japan

[21] Appl. No.: 534,885

[22] Filed: Jun. 8, 1990

[30] Foreign Application Priority Data

Jun. 13, 1989 [JP] Japan ..... 1-150899

[51] Int. Cl.[5] ..... H01J 29/07; H01J 9/14

[52] U.S. Cl. ..... 313/402; 313/403; 427/69; 427/70; 427/126.3; 445/47

[58] Field of Search ..... 313/402, 403, 407; 445/47; 427/69, 70, 126.3

[56] References Cited

U.S. PATENT DOCUMENTS 3,392,297 7/1968 Schwartz ..... 313/402
4,339,687 7/1982 Redington ..... 313/402
4,442,376 4/1984 Van Der Waal et al. ..... 313/402
4,751,424 6/1988 Tong ..... 313/402
4,810,927 3/1989 Watanabe ..... 313/402

FOREIGN PATENT DOCUMENTS 0176344 4/1986 European Pat. Off. .
0139463 10/1979 Japan .
076553 6/1980 Japan .
0165339 9/1984 Japan .
014459 4/1985 Japan .
0274525 11/1987 Japan .
2080612 2/1982 United Kingdom .

*Primary Examiner*—Donald J. Yusko
*Assistant Examiner*—Ashok Patel

[57] ABSTRACT

A method for manufacturing a color CRT includes the step of coating a shadow mask of the color CRT in black. It further includes the step of forming an electron beam reflecting film by depositing tungsten oxide with a large electron beam reflection coefficient on the side of an electron beam irradiated surface of the shadow mask coated in black.

4 Claims, 2 Drawing Sheets

METHOD FOR MANUFACTURING COLOR CATHODE RAY TUBE

FIELD OF THE INVENTION

The present invention relates to a method for manufacturing a color cathode ray tube having a shadow mask, More particularly, it relates to a method for manufacturing a color CRT comprising the step of forming a reflecting film formed of a material having a large electron beam reflection coefficient on the side of an electron beam irradiated surface of a shadow mask, in order to reduce a doming amount of the shadow mask.

BACKGROUND OF THE INVENTION

FIG. 3 is a partially broken side view showing a construction of conventional shadow mask type color CRT. In FIG. 3, reference numeral 1 designates an outer frame whose inside is kept highly vacuous. An electron gun 2 for emitting three electron beams is contained in the outer frame 1. Reference numeral 3 designates a shadow mask serving as a color selecting electrode, which is formed of, for example thin iron plate having multiple slits.

Reference numeral 4 designates a translucent glass panel serving as a part of the outer frame 1. A fluorescent screen 5 is formed on an inner surface of the glass panel 4. Stripes or dots of fluorescent materials emitting red, green and blue light are then applied on the inner surface in regular succession. This stripe group or dot group are provided to precisely correspond to the slits of the shadow mask electro-optically. Reference numeral 6 designates a deflecting apparatus for deflecting and scanning the electron beam. Reference numeral 8 designates a support spring which is provided between the shadow mask 3 and outer 1. Usually, four support springs are provided. Reference numeral 9 designates an IMS (internal magnetic shield) which prevents floating magnetism, for example earth magnetism, from affecting unfavorably upon the CRT.

Operation of the above-described CRT will be described.

Three electron beams emitted from the electron gun 2 are deflected by the deflecting apparatus 6 so as to scan the whole surface of the fluorescent screen 5 and then reach the shadow mask 3. The shadow mask 3 has a color selecting function by which the three electron beams each hit only the stripe or dot of the fluorescent material having the corresponding color.

It is originally set so that positions of the stripes or dots on the fluorescent screen 5 precisely correspond to positions of the slits of the shadow mask 3. However, in actual operation of the color CRT, approximately 80% of the electron beams emitted from the electron gun are shielded by the shadow mask 3 because they collide with it. Therefore, unnecessary heat energy is transferred to the shadow mask 3 and a temperature of the shadow mask 3 is increased. As a result, the shadow mask deforms because of thermal expansion. The positional relationship between the slits of the shadow mask 3 and the stripes or dots of the fluorescent screen 5, which are set so as to correspond to each other, are shifted, causing color deviation.

A method for solving those problems is disclosed in Japanese Patent Laid Open Gazette No. 55-76553, in which an electron beam reflecting film 7 formed of material having electron beam reflection coefficient larger than that of a material constituting the shadow mask 3 is produced on an electron beam irradiated surface of the shadow mask 3.

In addition, as shown in Japanese Patent Publication Gazette No. 60-14459, a method is proposed in which the electron beam reflected film 7 is formed by a spraying solution, comprising a material of heavy metal having an atomic number of more than 70, to the electron beam irradiated surface of the shadow mask 3. More specifically, bismuth oxide powder is used as the above mentioned heavy metal and water glass and an appropriate amount of pure water are added to the bismuth oxide powder. Then, the bismuth powder is pulverized, until its average grain diameter becomes less than 1 micron, by performing ball mill and it is sprayed on the shadow mask 3. Then, it is air-dried and then thrown into the manufacturing process of the color CRT.

According to the conventional method for manufacturing the color CRT, since the electron beam reflecting film comprising a heavy metal or a heavy metal oxide is formed by spraying of a mixture of powder of a heavy metal or a heavy metal oxide and water glass, gas desorption of, for example $H_2O$, CO and $C0_2$ gas from the film by heating, electron irradiation and the like increases. Thus, a cathode of the CRT is considerably poisoned. As a result, an emission life characteristic of the cathode is degraded and the life of the CRT is reduced.

In addition, since the slit of the shadow mask of high resolution is very small, for example a dot radius is 130 microns and a dot pitch is 280 microns, when the spraying method is used, the above mentioned slit is blocked by secondary agglomeration of the sprayed material so that a blocking defect occurs. As a result, the manufacture of a CRT of high resolution is prevented. In addition, a voltage resistant characteristic of the tube is degraded because powder particles are peeled from the sprayed film.

SUMMARY OF THE INVENTION

The present invention was made to solve the above-described problems and it is an object of the present invention to provide a method for manufacturing a color CRT in which gas desorption from an electron beam reflecting film by heating, electron irradiation and the like occurs in less amount, degradation of the voltage resistant characteristic and a blocking defect are prevented, an emission life characteristic of a cathode is reliably maintained and the life thereof is increased.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the ar from this detailed description.

According to a method for manufacturing a color CRT in accordance with the present invention, an electron beam reflecting film is formed by depositing tungsten oxide, having a large electron beam reflection coefficient, on the side of the electron beam irradiated surface of a shadow mask which has been previously coated in black.

According to the present invention, since the electron beam reflecting film is formed by depositing tungsten oxide on the side of the electron beam irradiated surface of the shadow mask, an amount of impurity contamination to the electron beam reflecting film and that of adsorption of gas such as $H_2O$, $CO_2$, CO gas are considerably reduced. As a result, an amount of gas desorption caused by heating and of electron beam irradiation is considerably reduced and contamination to the cathode is decreased so that the emission life characteristic can be reliably maintained and the life of the color CRT can be increased.

Furthermore, since an intermediate layer is formed between the electron beam reflecting film and a film coated in black ($Fe_3O_4$ film) of the shadow mask by chemical reaction of those films, adhesion of the film can be increased and degradation of the voltage resistant characteristic caused by partial peeling of the film can be prevented.

In addition, since tungsten oxide is deposited by evaporation caused by sublimation, its deposited particles are in a gas state and do not generate secondary agglomeration differently from a case where a spraying method is employed in which secondary agglomeration of sprayed liquids is likely to be generated. As a result, a blocking defect that blocks very small slits of the shadow mask is not caused and thus a CRT of high resolution can be easily manufactured.

DETAILED DESCRIPTION OF PREFERRED EMBODIMENTS

An embodiment of the present invention will be described in detail hereinafter, with reference to the drawings hereinafter.

Figure 1:
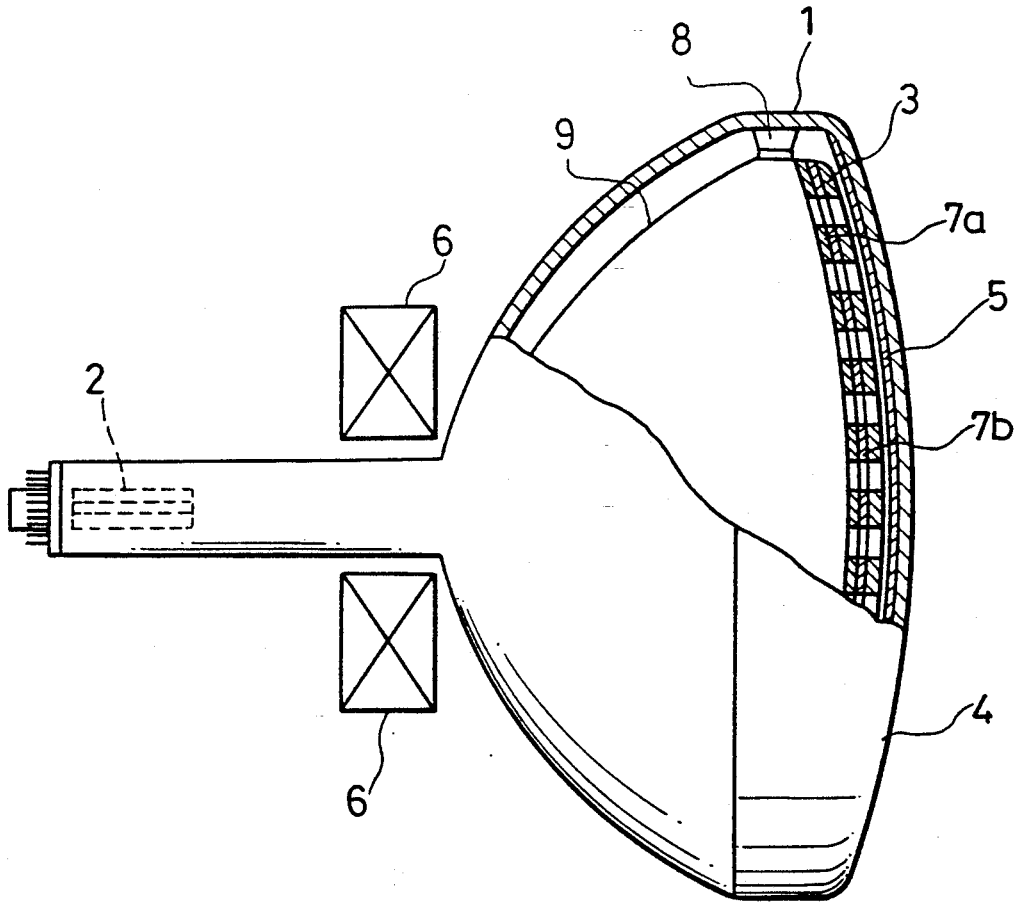
FIG. 1 is a partially broken side view showing a color CRT in accordance with an embodiment of the present invention.
Figure 2:
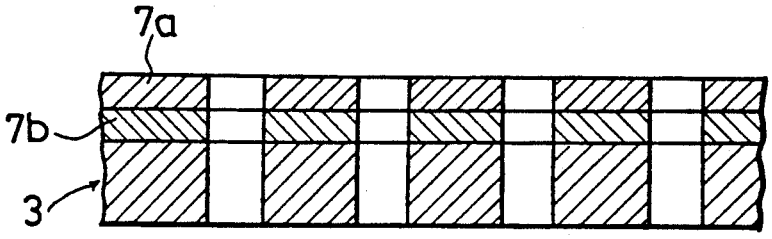
FIG. 2 is an enlarged view showing a shadow mask which is a main part in FIG. 1.

FIG. 1 is a partially broken side view showing a color CRT in accordance with an embodiment of the present invention. FIG. 2 is an enlarged view showing a shadow mask which is a main part of FIG. 1.

Figure 3:
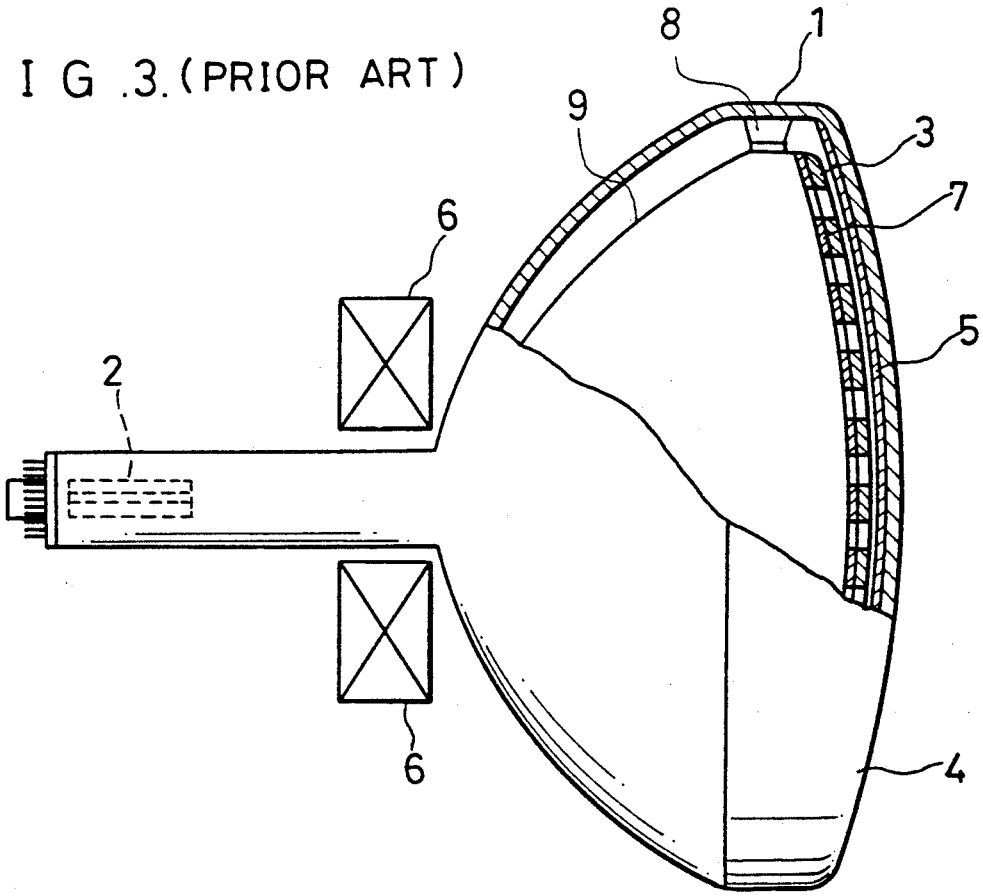
F I G .3.(PRIOR ART)
FIG. 3 is a partially broken side view showing a conventional color CRT.

In FIG. 1, since reference numerals 1 to 6 designate the same parts as previously discussed in conventional example shown in FIG. 3, the same references are allotted to the corresponding parts and a detailed description thereof is omitted.

In FIGS. 1 and 2, reference numeral *7b* designates a film coated in black ($Fe_3O_4$) formed on the electron beam irradiated side of the shadow mask 3 and reference numeral *7a* designates an electron beam reflecting film formed on the film *7b* coated in black. The electron beam reflecting film *7a* with the film thickness of 0.5 to 5 microns is formed of tungsten oxide ($WO_3$) by a deposition method such as a resistance heating method, a sputtering method, an electron beam method or ionized cluster beam (ICB) method.

In addition, the film thickness of the electron beam reflecting film *7a* is set so as not to be permeated by the electron beam. For example, when the electron beam is 27 KV, it is set at approximately 2 microns.

Next, a description is given of a manufacturing method in accordance with the present invention in a case where the electron beam reflecting film *7a* comprising tungsten oxide ($WO_3$) is formed by, for example, the resistance heating deposition method.

Powder of tungsten oxide as the deposition source is pressed such that an apparent density is, for example 4.5 $g/cm^3$ and a configuration is a rectangular parallelepiped of, for example $10\times30\times5$ mm at a room temperature or high temperature such as 300° C. The configuration can be also a cylinder.

The deposition source of tungsten oxide and the shadow mask 3 coated in black of a 20-inch high resolution color CRT are each arranged at predetermined positions in a vacuum vessel. Then, the vessel is exhausted until it is below a vacuum degree of $10^{-4}$ Torr by using an exhauster such as a rotary pump or an oil diffusion pump.

When the vacuum degree becomes below $10-4$ Torr, electric power to be supplied is increased until the temperature reaches a sublimation point (approximately 800° C.) of tungsten oxide as a deposition source and then a shutter is opened. Then, tungsten is deposited until a film thickness thereof becomes 2.0 microns (deposition time is, for example, approximately 10 minutes) on the electron beam irradiated surface of the shadow mask 3 and then the shutter is closed and the power is turned off.

Then, the vacuum valve of an exhaust system is closed and a leak valve is opened to take air into the vacuum vessel. Then the shadow mask 3 is taken out of the vacuum vessel.

Then, the shadow mask 3 is thrown into the normal manufacturing process of color CRT for manufacturing a 90-degree deflecting and 20-inch display type color CRT.

In addition, the shadow mask 3 used in the present invention is used not only for a color television CRT but also for a high resolution display tube having a very small dot diameter of, for example 130 microns and a small dot pitch of, for example 280 microns. In either case, the tube an arbitrary size.

Referring to adhesion of the electron beam reflecting film *7a* formed of tungsten oxide obtained as described above, no peeling occurs in a peeling test with a cellophane adhesive tape. Therefore, degradation of a voltage resistant characteristic of the tube is not caused by partial peeling of the electron beam reflecting film *7a*.

Next, a description is given of a result of an examination of the emission life characteristic of the cathode of the color CRT and the state of generating blocking of the shadow mask 3.

The emission life characteristic of the cathode is measured under the condition that the whole electron beam current (of three cathodes) is 0.9 mA, an electron beam acceleration voltage is 27 KV, a heater voltage is 6.3 V and a size is a standard raster size. As a result, the life characteristic of a maximum emission current of the color CRT having the shadow mask 3 obtained in accordance with the manufacturing method of the present invention is increased by approximately 20% as compared with the conventional color CRT of the same type.

In this case, since the electron beam reflecting film *7a* is formed by depositing tungsten oxide on the shadow mask 3, impurity contamination to the reflecting film *7a* and an amount of gas adsorption (for example, $H_2O$, $CO_2$ or CO) can be considerably reduced. Thus, gas desorption from the reflecting film *7a* by heat and electron beam irradiation occurs in a considerably reduced amount and contamination to the cathode is reduced. As a result, the emission life characteristic can be reliably maintained and the life of the CRT can be increased by approximately 20%.

On the other hand, there are two kinds of non-emission and emission types in evaluating the state of blocking. The non-emission type evaluation method is employed under the condition that tri-color raster scan is used, the whole electron beam current (of three cathodes) is 0.45 mA, the electron beam acceleration voltage is 27 KV, the heater voltage is 6.3 V, and the size is a standard raster size. In addition, the emission type evaluation method is employed under the condition that mono-color raster scan is used, the electron beam current (of one cathode) is 0.15 mA, the electron beam acceleration voltage is 27 KV, the heater voltage is 6.3 V and the size is the standard raster size.

Then, the states of the blocking of the non-emission and emission type are observed by the above-described blocking evaluation method. As a result, it is found that blocking of the non-emission and emission type is not generated in the color CRT having the high precision 20-inch shadow mask having, for example a dot diameter of 130 microns and a dot pitch of 280 microns which is obtained in accordance with the manufacturing method of the present invention.

In this case, since tungsten oxide is deposited on the shadow mask 3 by evaporation caused by sublimation, deposited particles are in a gas state so that no secondary agglomeration is generated. Therefore, according to the present invention, even if the high resolution shadow mask has considerably small slits, blocking of the slit is not caused in the color CRT.

As described above, according to the present invention, it is possible to highly maintain adhesion of the electron beam reflecting film on the shadow mask surface formed by the deposition method and also to prevent the blocking defect and improve a picture of the color CRT. The life of the color CRT can be increased by decreasing the impurity contamination to the reflecting film and the amount of the gas adsorption.

Although the present invention has been described and illustrated in detail, it is clearly understood that the same is by way of illustration and example only and is not to be taken by way of limitation; the spirit and scope of the present invention being limited only by the terms of the appended claims.

What is claimed is:

1. A method for manufacturing a color cathode ray tube having a shadow mask, comprising the steps of:

(a) coating the shadow mask with a black layer; and (b) depositing by evaporation caused by sublimation tungsten oxide, having a large electron beam reflection coefficient, on a side of the shadow mask coated in black to be irradiated by electron beams, to form an electron beam reflecting film to reduce doming of the shadow mask.

2. The method for manufacturing a color cathode ray tube of claim 1, wherein said black layer is iron oxide ($Fe_3O_4$).

3. A color cathode ray tube comprising:

an electron beam reflecting film formed by depositing by evaporation caused by sublimation tungsten oxide with a large electron beam reflection coefficient on the side of an electron beam irradiated surface of the shadow mask which is coated in black.

4. The color cathode ray tube of claim 3, wherein the black layer is iron oxide ($Fe_3O_4$).

* * * * *